US008077106B2

(12) United States Patent
Sato

(10) Patent No.: US 8,077,106 B2
(45) Date of Patent: Dec. 13, 2011

(54) RECEIVING ANTENNA COIL

(75) Inventor: Tsuyoshi Sato, Tokyo (JP)

(73) Assignee: Sumida Corporation, Chuo-ku, Tokyo (JP)

( * ) Notice: Subject to any disclaimer, the term of this patent is extended or adjusted under 35 U.S.C. 154(b) by 216 days.

(21) Appl. No.: 12/457,038

(22) Filed: May 29, 2009

(65) Prior Publication Data

US 2009/0295663 A1 Dec. 3, 2009

(30) Foreign Application Priority Data

Jun. 3, 2008 (JP) ..... 2008-145465

(51) Int. Cl.
*H01Q 7/08* (2006.01)

(52) U.S. Cl. ..... 343/788; 343/787; 343/895

(58) Field of Classification Search ..... 343/787, 343/788, 895
See application file for complete search history.

(56) References Cited

U.S. PATENT DOCUMENTS

| | | | | |
|---|---|---|---|---|
| 2004/0061660 | A1 | 4/2004 | Yoshida et al. | |
| 2006/0267853 | A1* | 11/2006 | Naito | 343/788 |
| 2007/0195001 | A1* | 8/2007 | Ueda | 343/788 |

FOREIGN PATENT DOCUMENTS

| | | | |
|---|---|---|---|
| DE | 27 32 950 | A1 | 2/1979 |
| EP | 1 376 762 | A1 | 1/2004 |
| EP | 1 727 236 | A1 | 11/2006 |
| EP | 1 887 587 | A1 | 2/2008 |
| JP | 2003-92509 | | 3/2003 |
| JP | 2007-266892 | | 10/2007 |
| WO | WO 2007/116797 | A1 | 10/2007 |

OTHER PUBLICATIONS

European Search Report dated Jul. 14, 2009.

* cited by examiner

*Primary Examiner* — Dieu H Duong
(74) *Attorney, Agent, or Firm* — McGinn IP Law Group, PLLC

(57) ABSTRACT

The present invention provides a receiving antenna coil capable of realizing both improvement in the reception characteristic and miniaturization. In a receiving antenna coil, at least one of an X-axis winding core part and a Y-axis winding core part is formed in a plurality of bars. While increasing occupancy of the winding core parts (the X-axis winding core part and the Y-axis winding core part) in a region in the XY plane surrounded by a Z-axis receiving coil, the length of the winding core parts can be assured long. Further, since the X-axis winding core part and the Y-axis winding core part are provided in the same plane, the height of the core is suppressed, and the dimension of the entire receiving antenna coil can be suppressed.

19 Claims, 11 Drawing Sheets

RECEIVING ANTENNA COIL

This application is based on Japanese patent application No. 2008-145465, the content of which is incorporated hereinto by reference.

BACKGROUND

1. Technical Field

The present invention relates to a receiving antenna coil in which coils are wound in X-axis, Y-axis, and Z-axis directions which cross one another.

2. Related Art

A receiving antenna coil is used, as an example, by being mounted on a remote controller for locking/unlocking a keyless entry system in a car or a house. To make transmission/reception of information between a control unit on a car or house side and the controller more reliable, in recent years, improvement in a reception characteristic of the receiving antenna coil is demanded. On the other hand, to improve portability for the user, a request for miniaturization of the receiving antenna coil is also increasing.

Techniques of this kind disclosed in, for example, Japanese Unexamined Patent Publication No. 2003-92509 and WO 2007/116797 are known. FIGS. 1 and 10 of Japanese Unexamined Patent Publication No. 2003-92509 show an antenna coil in which an X-axis receiving coil and a Y-axis receiving coil are wound so as to overlap each other.

FIG. 4 of Japanese Unexamined Patent Publication No. 2003-92509 and FIG. 1 of WO 2007/116797 show an antenna coil in which a receiving coil is wound around each of cores in a cross shape.

[Patent document 1] Japanese laid-open patent publication No. 2003-92509

[Patent document 2] International patent application publication No. WO 2007/116797

However, when coils are wound so as to overlap in the crossing direction, tension at the time of winding is concentratedly applied between coil wires, and there is the possibility that an insulating film on the surface of the coil is damaged. When the insulating film is damaged and the core wire of the coil wire is exposed, short-circuit of the coil occurs, the antenna characteristic deteriorates, and it becomes a problem. When X-axis and Y-axis receiving coils are wound so as to overlap each other like in the antenna coil described in Japanese Unexamined Patent Publication No. 2003-92509, it is difficult to reduce the height in the Z-axis direction, that is, the thickness dimension.

In the case of the cross-shaped core described in WO 2007/116797, it is difficult to wind a wire at the intersecting part of the cross, so that it is difficult to assure the sufficient number of turns of the coil. Since it is generally difficult to assure large volume of a cross-shaped core in a region in a Z-axis receiving coil disposed so as to surround X-axis and Y-axis receiving coils, it is difficult to sufficiently increase the reception characteristic of the X-axis and Y-axis receiving coils. When the winding core part is set long to increase the number of turns in one direction in the inner region in the Z-axis receiving coil whose dimensions are restricted, the width of the winding core part in the other direction has to be decreased. The winding length and the core volume have the trade-off relation.

The present invention is achieved in view of the problems and an object of the invention is to provide a receiving antenna coil capable of realizing both improvement in the reception characteristic and miniaturization.

SUMMARY

In one embodiment of the present invention, there is provided a receiving antenna coil having: a core including an X-axis winding core part extending in an X-axis direction and a Y-axis winding core part extending in a Y-axis direction crossing the X-axis direction; an X-axis receiving coil wound around the X-axis winding core part and a Y-axis receiving coil wound around the Y-axis winding core part; and a Z-axis receiving coil wound in a Z-axis direction crossing both the X-axis direction and the Y-axis direction so as to surround the X-axis winding core part and the Y-axis winding core part, wherein the X-axis winding core part and the Y-axis winding core part each made of a magnetic material are provided in the same plane, and at least one of the X-axis winding core part and the Y-axis winding core part is formed in a plurality of bars.

In the receiving antenna coil as an embodiment of the present invention, more concretely, the X-axis receiving coil or the Y-axis receiving coil may be wound around the X-axis winding core part or the Y-axis winding core part made in the plurality of bars, and the X-axis receiving coils or the Y-axis receiving coils wound around the plurality of bars may be connected to each other in a direction of adding currents excited by an external magnetic field.

In the receiving antenna coil as an embodiment of the present invention, more concretely, the core may be constructed by combining an X-axis core including the X-axis winding core part and a Y-axis core including the Y-axis winding core part, and at least one of the X-axis core and the Y-axis core may have an engagement part for making the X-axis core and the Y-axis core engage with each other.

In the receiving antenna coil as an embodiment of the present invention, more concretely, the core may be constructed by combining a plurality of the X-axis cores or the Y-axis cores, and the X-axis core may have one bar of the X-axis winding core part, or the Y-axis core may have one bar of the Y-axis winding core part.

In the receiving antenna coil as an embodiment of the present invention, more concretely, peripheral length of the engagement part may be longer than that of each of the X-axis winding core part and the y-axis winding core part, and the engagement part may be a flange that prevents loosening of the X-axis receiving coil or the Y-axis receiving coil.

In the receiving antenna coil as an embodiment of the present invention, more concretely, the engagement part may be made of a resin material, the X-axis winding core part and the Y-axis winding core part may be made of a ferrite material, and the X-axis core or the Y-axis core having the engagement part may be constructed by combining the engagement part and the X-axis winding core part or the Y-axis winding core part attached to the engagement part.

In the receiving antenna coil as an embodiment of the present invention, more concretely, each of the X-axis core and the Y-axis core may have the engagement part, and the engagement part of the X-axis core and the engagement part of the Y-axis core may have the same shape.

In the receiving antenna coil as an embodiment of the present invention, more concretely, the core may have a rectangular loop shape or an H-letter shape in an XY plane.

More concretely, the receiving antenna coil as an embodiment of the present invention may further include a Z-axis core made of a nonmagnetic material, around which the Z-axis receiving coil is to be wound.

In the receiving antenna coil as an embodiment of the present invention, more concretely, the Z-axis core may have a tube shape, and the core may be housed in the Z-axis core.

In the present invention, the expression that the X-axis winding core part and the Y-axis winding core part are in the same plane means the winding core parts have overlap parts in the thickness direction, that is, the Z-axis direction and does not require that the center lines of the winding core parts strictly coincide with the Z-axis direction.

In the present invention, the expression that one of the X-axis winding core part and the Y-axis winding core part is formed in a plurality of bars refers to a state where the X-axis winding core parts using the X-axis direction as the winding direction are provided in a plurality of places in the Y-axis direction, or a state where the Y-axis winding core parts using the Y-axis direction as the winding direction are provided in a plurality of places in the X-axis direction.

Various components of the present invention such as the winding core parts, the receiving coils, and the cores do not have to be independent of each other. A plurality of components may be formed as a single member. One component may be formed by a plurality of members. A component may be a part of another component. A part of a component and a part of another component may be overlapped.

In the receiving antenna coil of the present invention, by making an X-axis winding core part or a Y-axis winding core part of a plurality of bars in a limited region surrounded by a Z-axis receiving coil, the length of the winding core part and the volume of the core are balanced and largely assured, so that the reception characteristic improves. Since a coil is wound around each of the X-axis winding core part and the Y-axis winding core part, the X-axis receiving coil and the Y-axis receiving coil are not wound so as to overlap each other. Therefore, the thickness of the coil can be reduced, and a problem of damage on the coil does not occur. Thus, both improvement in the reception characteristic and miniaturization of the receiving antenna coil are realized.

BRIEF DESCRIPTION OF THE DRAWINGS

The above and other objects, advantages and features of the present invention will be more apparent from the following description of certain embodiments taken in conjunction with the accompanying drawings, in which.

DETAILED DESCRIPTION

Figure 1:
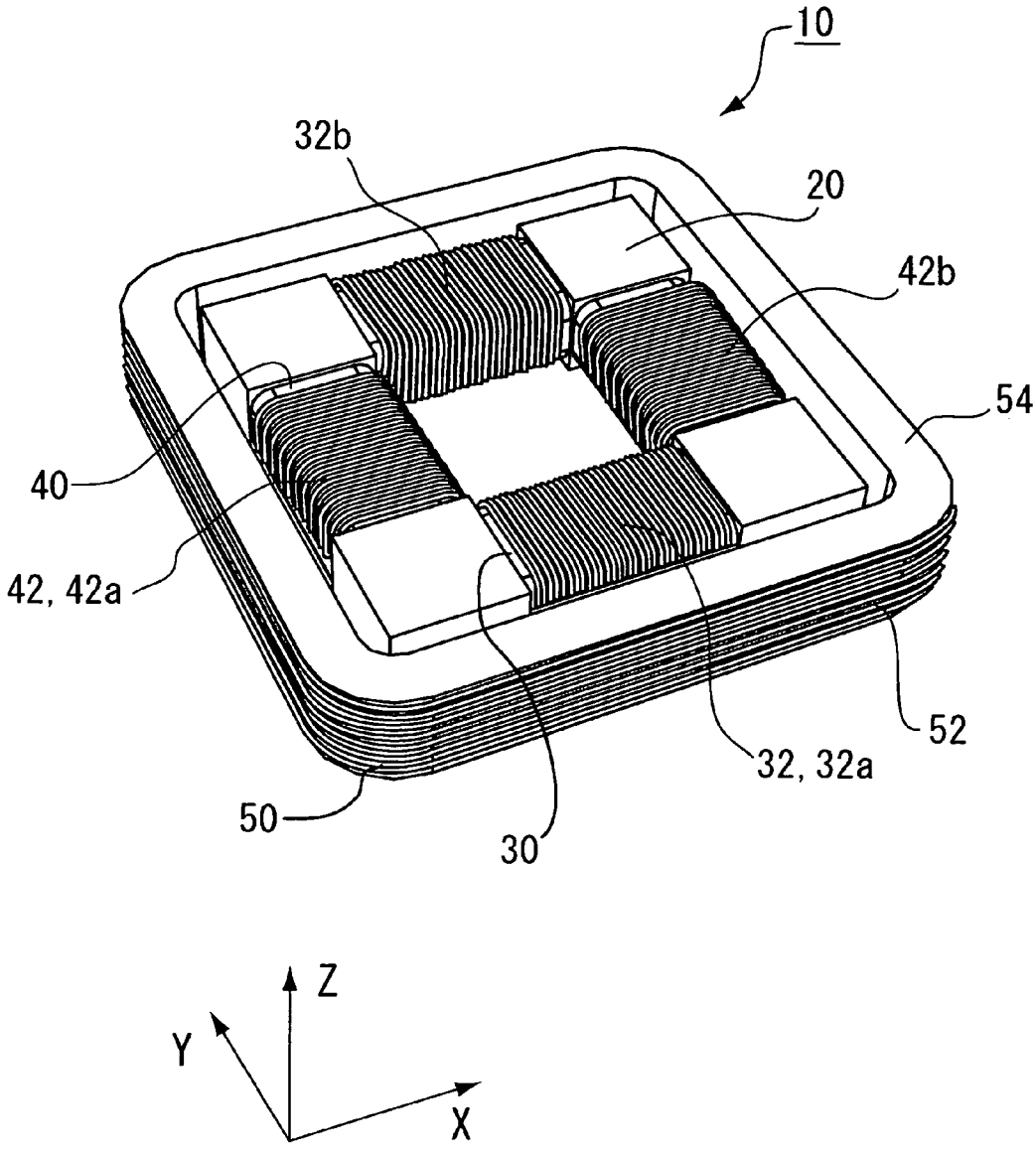
FIG. 1 is a perspective view showing an example of a receiving antenna coil as a first embodiment of the present invention.

The invention will now be described with reference to illustrative embodiments. Those skilled in the art will recognize that various alternative embodiments can be accomplished using the teachings herein, and that the invention is not limited to exemplary embodiments illustrated for explanatory purposes.

Embodiments of the present invention will be described below with reference to the drawings. In all of the drawings, similar reference numerals are designated to similar components and repetitive description will not be given.

First Embodiment

FIG. 1 is a perspective view showing an example of a receiving antenna coil 10 according to a first embodiment of the present invention.

First, outline of the receiving antenna coil 10 of the embodiment will be described.

The receiving antenna coil 10 of the embodiment includes: a core 20 having an X-axis winding core part 30 extending in the X-axis direction and a Y-axis winding core part 40 extending in the Y-axis direction that crosses the X-axis direction; an X-axis receiving coil 32 wound around the X-axis winding core part 30; a Y-axis receiving coil 42 wound around the Y-axis winding core part 40; and a Z-axis receiving coil 52 wound in the Z-axis direction crossing both the X-axis direction and the Y-axis direction so as to surround the X-axis winding core part 30 and the Y-axis winding core part 40.

The X-axis winding core part 30 and the Y-axis winding core part 40 each made of a magnetic material are provided in the same plane, and at least one of the X-axis winding core part 30 and the Y-axis winding core part 40 is formed in a plurality of bars.

Next, the receiving antenna coil 10 of the embodiment will be described in detail.

The receiving antenna coil 10 is constructed by combining the core 20 including two bars of X-axis winding core parts 30 and two bars of Y-axis winding core parts 40 and a Z-axis core 54 having one bar of Z-axis winding core part 50. In the embodiment, each of the X-axis winding core part 30 (X-axis winding core parts 30*a* and 30*b*) and the Y-axis winding core part 40 (Y-axis winding core parts 40*a* and 40*b*) is formed in a plurality of bars (two bars).

Figure 2:
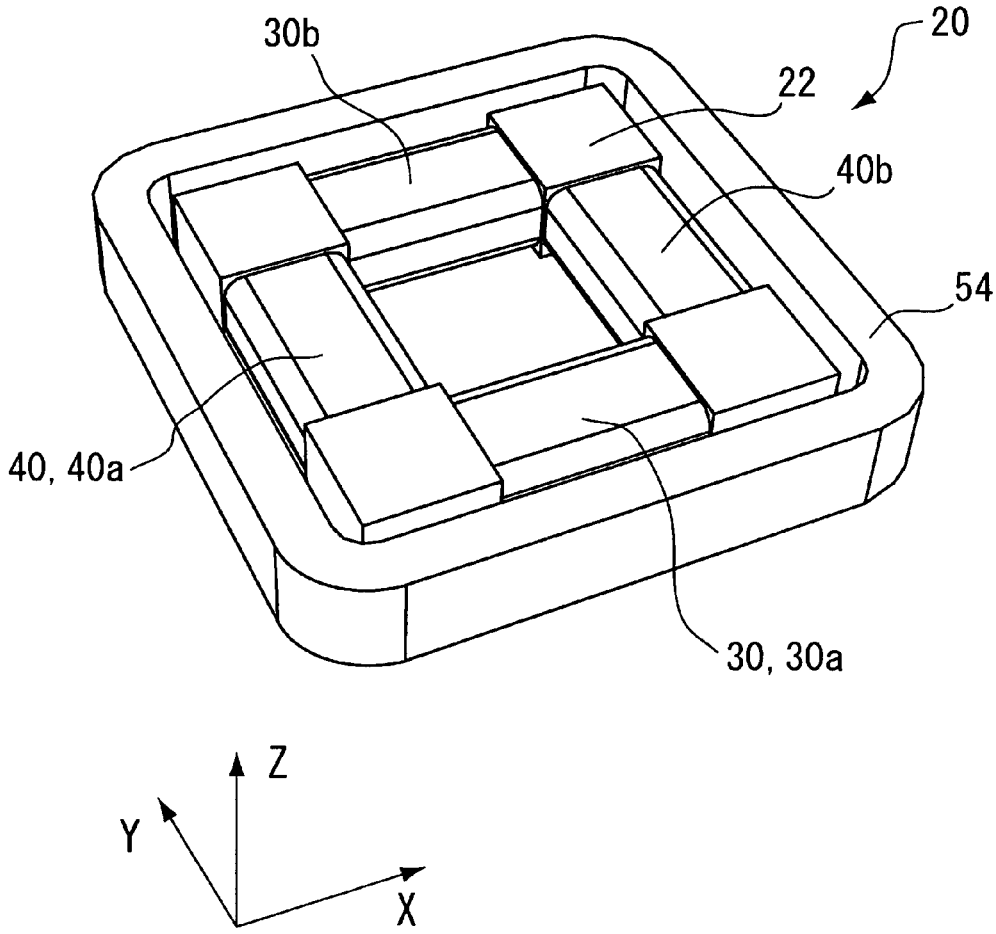
FIG. 2 is a perspective view of a core and a Z-axis core.

FIG. 2 is a perspective view of the core 20 and a Z-axis core 54.

The core 20 has a rectangular loop shape, that is, an open rectangular shape in the XY plane. Each of the X-axis winding core parts 30 and the Y-axis winding core parts 40 corresponding to the sides of the core 20 having the rectangular loop shape has a rod shape. At four corners of the core 20, blocks 22 as flanges for the X-axis winding core parts 30 and the Y-axis winding core parts 40 are formed. Peripheral length of the block 22 is longer than that of each of the X-axis winding core part 30 and the Y-axis winding core part 40. Loosening in the winding direction of the X-axis receiving coil 32 and the Y-axis receiving coil 42 wound is regulated by the blocks 22.

The peripheral length of the block 22, the X-axis winding core part 30, or the Y-axis winding core part 40 is length of one loop in the case of winding coil around the part.

The core 20 is made of a magnetic material. In the case of the embodiment, the core 20 is made of ferrite from the viewpoint high magnetic permeability and availability. As specifically described later in the embodiment, the core 20 may be made of a plurality of materials. In this case, it is preferable to make at least the X-axis winding core part 30 and the Y-axis winding core part 40 of a magnetic material.

On the other hand, the Z-axis core 54 around which the Z-axis receiving coil 52 winds is made of a resin material as a nonmagnetic material. The Z-axis core 54 surrounds the core 20. The Z-axis receiving coil 52 winds around the magnetic material (core 20). Therefore, even when the Z-axis core 54 is made of the nonmagnetic material, the high reception characteristic of the Z-axis receiving coil 52 can be obtained.

The Z-axis core 54 in the embodiment has a tube shape, and the core 20 is housed in the Z-axis core 54. The tube-shaped Z-axis core 54 is a short tube whose dimension in the radial direction is larger than that in the axial direction. The axial direction of the Z-axis core 54 is directed in the Z-axis direction.

The shape of the opening of the Z-axis core 54 having the tube shape, that is, the shape viewed from the Z-axis direction is not limited. As an example, the shape may be a rounded-corner square shape shown in FIGS. 1 and 2 or a circular shape.

In the core 20 of the embodiment, two X-axis winding core parts 30 and two Y-axis winding core parts 40 formed in total four bars, two bars in the X-axis direction and two bars in the Y-axis direction, are formed having the same sectional area and the same length. Therefore, the shape of the core 20 in plan view (in the XY plane) is a square shape. The number of turns of the X-axis receiving coil 32 and that of the Y-axis receiving coil 42 are equal to each other. With the configuration, the reception characteristic of the receiving antenna coil 10 is isotropic in the XY plane.

The shape of the cross section of the X-axis winding core part 30 and the Y-axis winding core part 40, that is, a section taken perpendicular to the winding direction is a corner-rounded rectangle. Long sides of the rectangular section are in the XY plane, and short sides are in the Z-axis direction. With the configuration, while increasing occupancy of the core 20 in the XY plane, the thickness dimension (height in the Z-axis direction) of the core 20 is suppressed.

Length of one bar of the two bars of X-axis winding core parts 30 and the Y-axis winding core parts 40 is longer than each of the sides of the cross section.

The Z-axis core 54 having therein the core 20 has a rectangular tube shape, and the winding length of the Z-axis winding core part 50 is equal to the thickness dimension of the core 20. Therefore, the winding area of the Z-axis receiving coil 52 is larger than that of each of the X-axis receiving coil 32 and the Y-axis receiving coil 42. The winding length of the Z-axis receiving coil 52 is shorter than that of each of the X-axis receiving coil 32 and the Y-axis receiving coil 42. With the configuration, while suppressing the thickness dimension of the receiving antenna coil 10, the reception sensitivity in the Z-axis direction is adjusted to be equal to that in the X-axis direction and the Y-axis direction. As the shape of the Z-axis core 54, a flange may be formed on the upper side and the lower side in the Z-axis direction. By the flanges, the Z-axis receiving coil 54 can be easily wound.

In the core 20, the X-axis receiving coil 32 (X-axis receiving coils 32*a* and 32*b*) and the Y-axis receiving coil 42 (Y-axis receiving coils 42*a* and 42*b*) are wound around the two bars of X-axis winding core parts 30*a* and 30*b* and the two bars of Y-axis winding core parts 40*a* and 40*b*, respectively. The X-axis receiving coils 32*a* and 32*b* are electrically connected to each other, and the Y-axis receiving coils 42*a* and 42*b* are electrically connected to each other.

That is, in the receiving antenna coil 10 of the embodiment, the X-axis receiving coils 32 are wound around the plurality of bars of X-axis winding core parts 30, and the Y-axis receiving coils 42 are wound around the plurality of bars of Y-axis winding core parts 40. The X-axis receiving coils 32 or the Y-axis receiving coils 42 wound around the plurality of bars are connected in the direction in which current excited by external magnetic fields (induced currents I) are added to each other.

In the receiving antenna coil 10 of the embodiment, the X-axis receiving coils 32 are wound around all of the X-axis winding core parts 30, and the Y-axis receiving coils 42 are wound around all of the Y-axis winding core parts 40.

The connection mode of the receiving coils (the X-axis receiving coils 32 and the Y-axis receiving coils 42) will be described concretely with reference to FIGS. 3 and 4.

Figure 3:
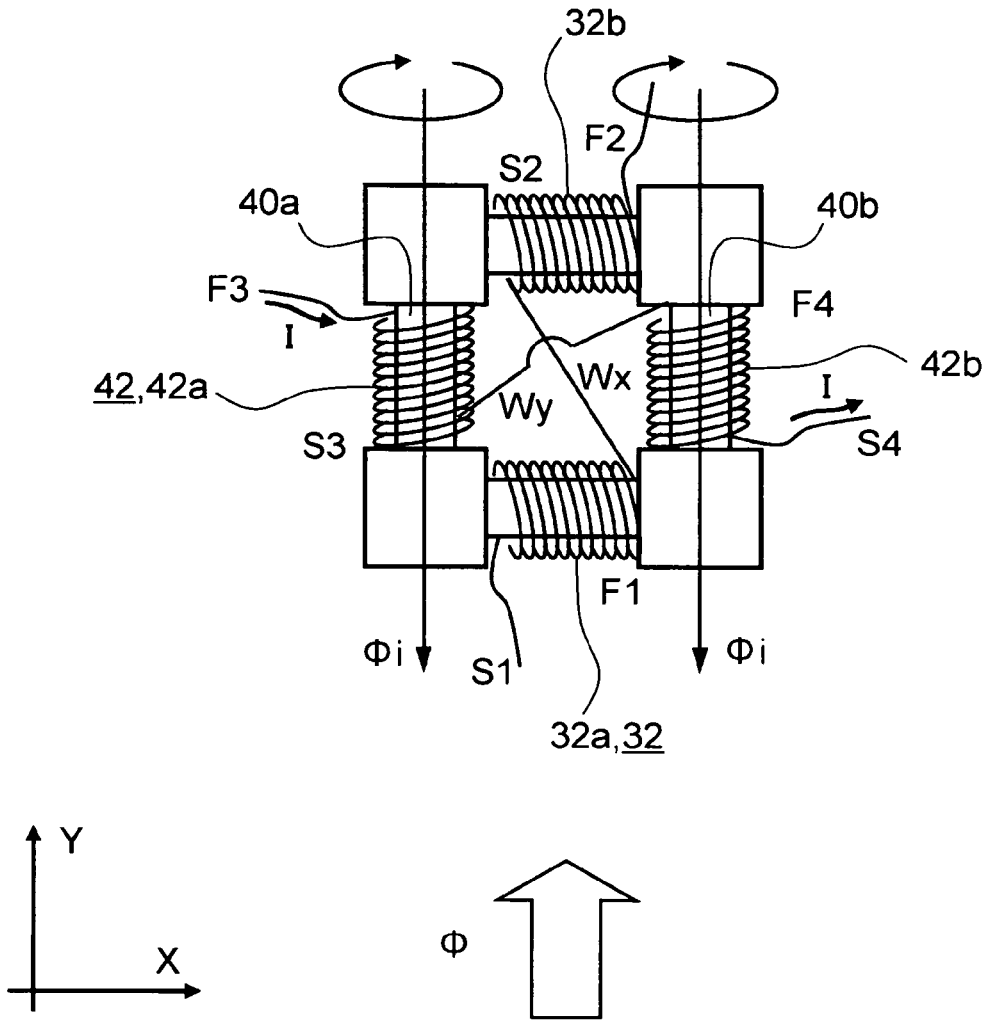
FIG. 3 is an XY plane schematic view of a core as an example of a connection mode of receiving coils.

FIG. 3 is an XY plane schematic view of the core 20 as an example of the connection mode of receiving coils. In the core 20, the winding directions of the two receiving coils which are in parallel with each other are made common in each of the X-axis and Y-axis directions, and the starting end of one of the two receiving coils and the terminating end of the other receiving coil are connected to each other. For convenience, the winding end on the smaller coordinate value side in the receiving coils (the X-axis receiving coil 32 and the Y-axis receiving coil 42) in each of the axis directions is called the starting end of the receiving coils. The winding end on the larger coordinate value side is called the terminating end of the receiving coils.

In FIG. 3, the Z-axis core 54 and the Z-axis receiving coil 52 are not shown.

Concretely, the winding directions of the X-axis receiving coils 32*a* and 32*b* are made common (for example, clockwise spiral winding), a terminating end F1 of the winding of the X-axis receiving coil 32*a* and a starting end S2 of the winding of the X-axis receiving coil 32*b* are electrically connected to each other via a wire Wx.

In place of the mode of directly connecting the terminating end F1 and the starting end S2 via the wire Wx, the X-axis receiving coils 32*a* and 32*b* may be electrically connected to each other via external terminals provided for the core 20. Concretely, the terminating end F1 of the X-axis receiving coil 32*a* may be connected to one external terminal (not shown), the starting end S2 of the X-axis receiving coil 32*b* may be connected to the other external terminal (not shown), and the external terminals may be electrically connected to each other.

Y-axis receiving coils 42*a* and 42*b* are connected similarly. Their winding directions are common (for example, the clockwise spiral winding), and a starting end S3 of the Y-axis receiving coil 42*a* and a terminating end F4 of the Y-axis receiving coil 42*b* are electrically connected to each other via a wire Wy.

The direction of a magnetic flux Φ of the external magnetic field is set as a +Y direction for simplicity. When the core 20 is in the magnetic field, induced current flows in the Y-axis receiving coil 42. The fluctuation scale of the gradient of the external magnetic field is sufficiently larger than that of the receiving antenna coil 10, and a common magnetic flux Φ acts on a plurality of bars of winding core parts (the Y-axis winding core parts 40*a* and 40*b*). Consequently, an induced magnetic field Φ in a −Y direction and an induced current I corresponding to the induced magnetic field Φi are generated. The directions of the induced currents I flowing in the pair of Y-axis receiving coils 42*a* and 42*b* whose winding directions are common become common as shown by the arrows in FIG. 3.

Therefore, by connecting the starting end S3 of the Y-axis receiving coil 42*a* and the terminating end F4 of the Y-axis receiving coil 42*b*, the induced currents I generated in the winding core parts are added to each other. By outputting current values or voltage values of the induced currents I as reception signals, the receiving antenna coil 10 can detect a change in the magnetic flux Φ.

In place of the above-described coupling mode, the terminating end F3 of the Y-axis receiving coil 42*a* and the starting end S4 of the Y-axis receiving coil 42*b* may be connected to each other. The case where the magnetic flux Φ of the external magnetic field has a component in the X direction is also similar to the above. Induced currents flowing in the same direction are generated in the pair of X-axis receiving coils 32*a* and 32*b* whose winding directions are common. Consequently, by connecting a starting end of one of a pair of receiving coils and a terminating end of the other of the pair of receiving coils, currents (induced currents I) excited by the external magnetic field are added to each other.

Figure 4:
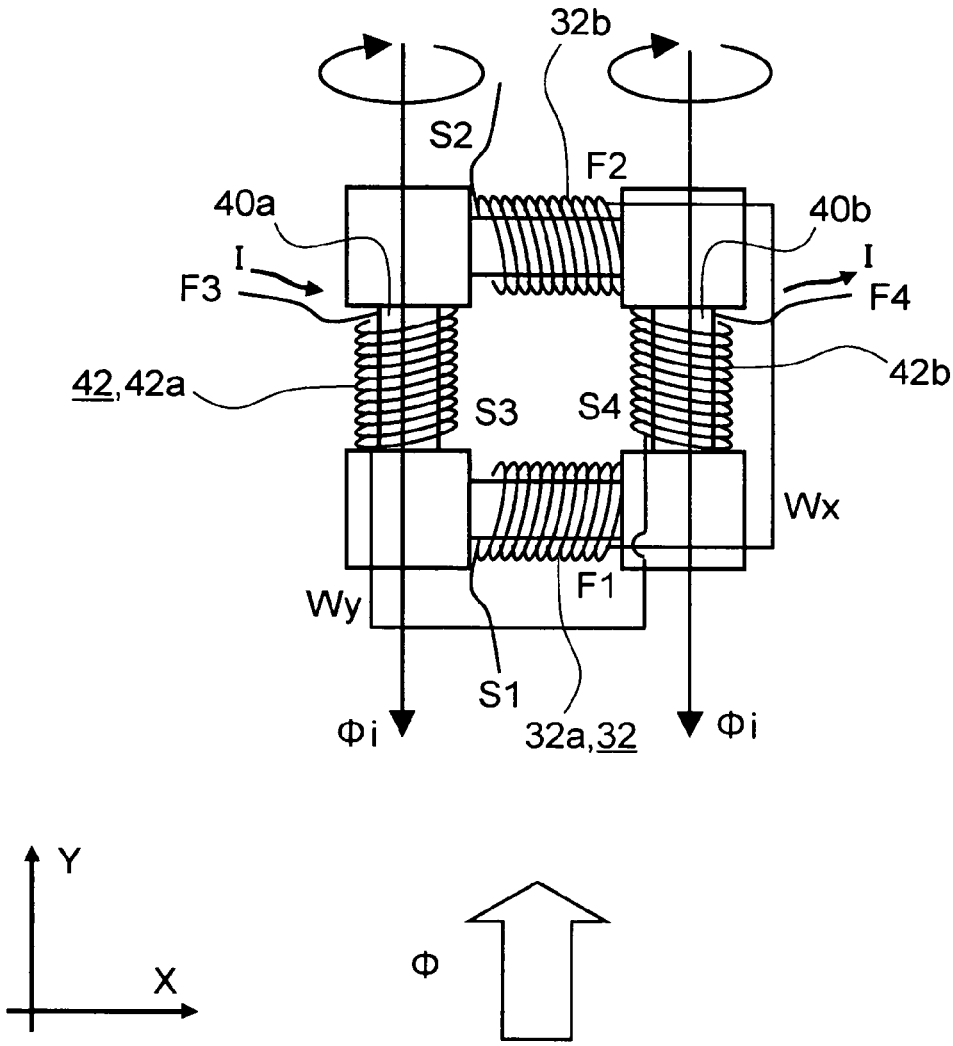
FIG. 4 is an XY plane schematic view of a core as another example of the connection mode of receiving coils.

FIG. 4 is an XY plane schematic view of the core 20 showing another example of the connection mode of receiving coils. In the core 20, the winding directions of the two receiving coils which are in parallel with each other are made opposite to each other in each of the X-axis and Y-axis directions, and the starting ends or the terminating ends are connected to each other. Concretely, the winding direction of the Y-axis receiving coil 42*a* is set as clockwise spiral winding, and the winding direction of the Y-axis receiving coil 42*b* is set as counterclockwise spiral winding. A starting end S3 of the Y-axis receiving coil 42*b* and a starting end S4 of the Y-axis receiving coil 42*b* are connected to each other via a wire Wy.

Similarly, the winding direction of the X-axis receiving coil 32*a* which is parallel is set as counterclockwise spiral winding, and the winding direction of the X-axis receiving coil 32*b* is set as clockwise spiral winding. A terminating end F1 of the X-axis receiving coil 32*a* and a terminating end F2 of the X-axis receiving coil 32*b* are connected to each other via a wire Wx.

When the receiving antenna coil 10 is put in the magnetic flux Φ in the +Y direction as shown in the diagram, induction magnetic fields Φi included by the Y-axis receiving coils 42*a* and 42*b* are in the −Y direction and common. Consequently, the spiral directions in which the induced current I flows are also counterclockwise directions and common in the Y-axis direction as shown in the diagram. Therefore, in the Y-axis receiving coils 42*a* and 42*b* whose winding directions are opposite to each other, the travel directions in the winding direction of the induced currents I are opposite to each other.

Therefore, by connecting the starting ends or the terminating ends of the two receiving coils disposed in parallel and whose winding directions are opposite to each other, the induced currents I excited by the external magnetic field are added to each other.

The effects of the receiving antenna coil 10 of the embodiment will be described.

In the receiving antenna coil 10 of the embodiment, the Z-axis receiving coil 52 is wound so as to surround the X-axis winding core parts 30 around which the X-axis receiving coils 32 are wound and the Y-axis winding core parts 40 around which the Y-axis receiving coils 42 are wound. With the configuration, changes in the external magnetic field in the direction of the three axes X, Y, and Z can be received. Since the Z-axis receiving coil 52 has the large winding area surrounding the entire core 20, even when the winding length of the Z-axis receiving coil 52 is suppressed to be short, reception sensitivities in the directions of three axes X, Y, and Z can be equivalently obtained. As a result, the receiving antenna coil 10 which is generally thin can be obtained. In particular, in the receiving antenna coil 10 of the embodiment, the X, Y, and Z axes correspond to orthogonal three axis directions. The isotropic nondirectional receiving antenna is provided.

In the receiving antenna coil 10, at least one of the X-axis winding core part 30 or the Y-axis winding core part 40 made of the magnetic material is formed in a plurality of bars. With such a configuration, while increasing occupancy of the winding core parts (the X-axis winding core part 30 and the Y-axis winding core part 40) in the region in the XY plane surrounded by the Z-axis receiving coil 52, the long winding core parts can be assured. Further, since the X-axis winding core part 30 and the Y-axis winding core part 40 are in the same plane, the height of the core 20 is suppressed, and the dimension of the entire receiving antenna coil 10 can be suppressed.

In the receiving antenna coil 10 that receives fluctuations in the magnetic flux Φ of the external magnetic field, the volume of the winding core parts through which the magnetic flux Φ passes exerts a large influence on the reception characteristic. In particular, the inventors of the present invention clarified from their study that, by making the winding core parts extending in the direction of the magnetic flux Φ sufficiently long while assuring the sectional area, which is large to some degree, of the winding core part taken perpendicular to the direction of the magnetic flux Φ, the reception sensitivity of the receiving coils (the X-axis receiving coil 32 ad the Y-axis receiving coil 42) to the magnetic flux Φ can be increased.

In the case of housing a cross-shaped core having only one bar of winding core part in the X direction and only one bar of winding core part in the Y direction in the Z-axis core, increase in the length of one of the winding cores means decrease in the sectional area of the other winding core part. Due to this, in the conventional cross-shaped core, it is difficult to sufficiently obtain the sectional area and the length of the winding core parts in the X and Y directions in the limited area surrounded by the Z-axis winding core part. On the other hand, by providing the core 20 with the plurality of bars of winding core parts as in the embodiment, while assuring the sectional area of the winding core parts which is the same as that of the conventional core or more, the total length of the winding core parts can be sufficiently increased. That is, in the case where the thickness dimension of the core and the winding pitch of the wire are the same as those in the conventional core, as compared with various cross-shaped cores each housed in a predetermined rectangular region, the core 20 having the plurality of bars of winding core parts as in the embodiment has higher reception sensitivity.

In the embodiment, the receiving coils (the X-axis receiving coil 32 and the Y-axis receiving coil 42) are wound around the plurality of bars of winding core parts (in the embodiment, the X-axis winding core parts 30 and the Y-axis winding core parts 40). In the receiving coils wound in the plurality of bars, the coils in the same direction are connected to each other, and currents (induced currents I) excited by the external magnetic field are added to each other. In such a manner, all of the magnetic fluxes Φ of the external magnetic fields flowing in the winding core parts made of the magnetic material are captured by any receiving coils, so that high reception characteristic of the receiving antenna coil 10 can be obtained.

In the embodiment, the core 20 has a rectangular loop shape in the XY plane. It is therefore easy to make the reception sensitivity in the XY plane isotropic. Since the positional relation between the Z-axis receiving coil 52 and the core 20 is made common in four sides of the core 20, the Z-axis receiving coil 52 can be wound stably.

In the receiving antenna that senses a change in the external magnetic field by the receiving coils and converts the change into a current signal or a voltage signal, different from a transmission antenna, the magnetic permeability of the magnetic flux Φ is high. Consequently, a loop core can be used as the core 20 as in the embodiment. Even when the magnetic flux Φ induced by the receiving coil circles in the ±X and Y directions in the core 20, adverse influence is not exerted on the reception characteristic.

The receiving antenna coil 10 of the embodiment further includes the Z-axis core 54 made of a nonmagnetic material, around which the Z-axis receiving coil 52 is to be wound. With the configuration, the Z-axis receiving coil 52 does not directly overlap the X-axis receiving coils 32 and the Y-axis receiving coils 42, and the coils are not damaged by tension at the time of winding. Winding of the X-axis receiving coils 32 and the Y-axis receiving coils 42 around the core 20 and winding of the Z-axis receiving coil 52 around the Z-axis core 54 can be performed separately. Thus, it is easy to manufacture the receiving antenna coil 10.

By making the Z-axis core 54 of a nonmagnetic material, inflow of the magnetic flux Φ to the X-axis winding core parts 30 and the Y-axis winding core parts 40 is not disturbed.

In the receiving antenna coil 10 of the embodiment, the Z-axis core 54 may not be provided and the Z-axis receiving coil 52 may be formed as an air core coil. In this case, by attaching the Z-axis receiving coil 52 as an air core coil to the periphery of the core 20 around which the X-axis receiving coil 32 and the Y-axis receiving coil 42 are wound, the receiving antenna coil 10 can be obtained.

Second Embodiment

Figure 5:
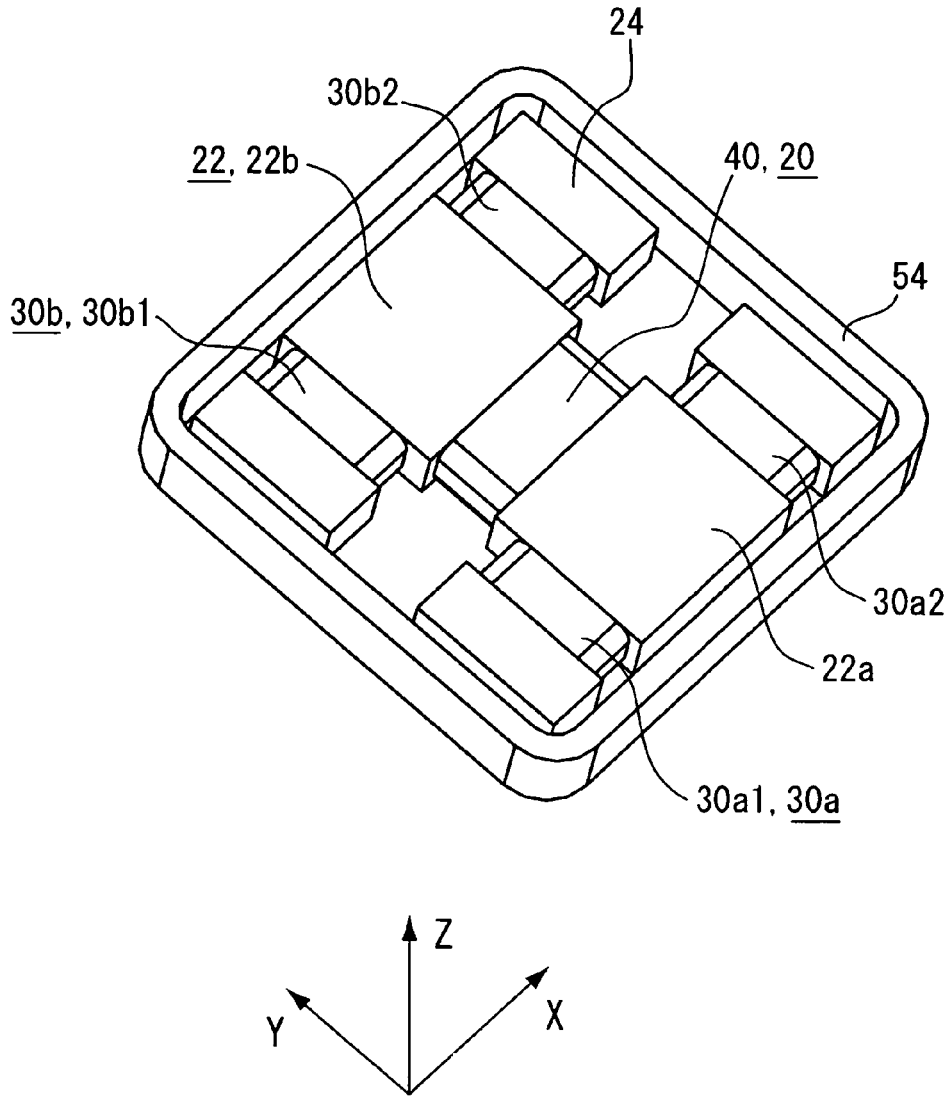
FIG. 5 is a perspective view showing an example of a core as a second embodiment.

FIG. 5 is a perspective view showing an example of the core 20 in the receiving antenna coil 10 in the embodiment.

The core 20 of the embodiment has an H-letter shape in the XY plane. Concretely, a plurality of (two) bars of X-axis winding core parts 30 (X-axis winding core parts 30*a* and 30*b*) extending in the X-axis direction are formed in parallel. Intermediate parts in the longitudinal direction of the X-axis winding core parts 30 are connected to each other via a single bar of Y-axis winding core part 40 extending in the Y-axis direction.

The X-axis winding core part 30*a* has winding core parts (X-axis winding core parts 30*a*1 and 30*a*2) in two places partitioned by a block 22*a*. The X-axis winding core parts 30*a*1 and 30*a*2 are provided apart from each other on the same axis. The Y-axis winding core part 30*b* has a similar configuration. Core winding parts (X-axis winding core parts 30*b*1 and 30*b*2) in two places are provided apart from each other on the same axis by a block 22*b*.

The Y-axis winding core part 40 is provided between the blocks 22*a* and 22*b*.

Peripheral length in each of the X-axis and Y-axis directions of the block 22 (blocks 22*a* and 22*b*) is longer than that of each of the X-axis winding core part 30 and the Y-axis winding core part 40. The block 22 functions as a flange that prevents loosening of wires wound.

At both ends in the extending direction of each of the two bars of X-axis winding core parts 30, end blocks 24 each having peripheral length larger than that of the X-axis winding core part 30 are formed, thereby preventing loosening of the wires at both ends of the X-axis winding core part 30.

The sectional area of the single bar of Y-axis winding core part 40 is larger than that of each of the two bars of X-axis winding core parts 30. Consequently, by adjusting the number of turns of the X-axis receiving coil 32 wound around the X-axis winding core part 30 (the X-axis winding core parts 30*a*1, 30*a*2, 30*b*1, and 30*b*2) and the number of turns of the Y-axis receiving coil 42 wound around the Y-axis winding core part 40, reception sensitivities in the X direction and the Y direction in the receiving antenna coil 10 can be adjusted to be equal.

In a manner similar to the first embodiment, the Z-axis core 54 having a rectangular tube shape is assembled to the periphery of the core 20, and the Z-axis receiving coil 52 is wound. By adjusting the number of turns of the Z-axis receiving coil 52, the reception sensitivity of the receiving antenna coil 10 can be made isotropic in the directions of the three axes.

Figure 6:
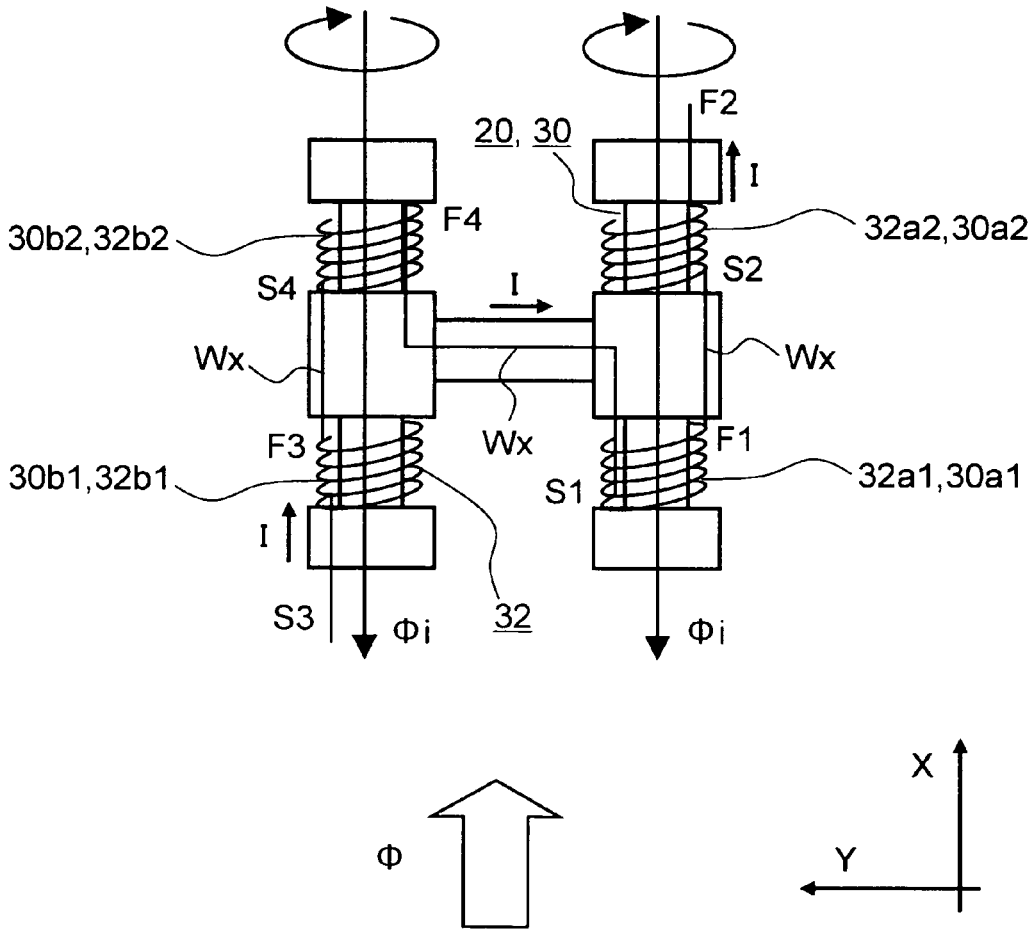
FIG. 6 is an XY plane schematic view showing a first example of a winding mode of an X-axis receiving coil of the embodiment.

FIG. 6 is an XY plane schematic view showing a first example of a winding mode of the X-axis receiving coil 32 wound around the X-axis winding core part 30 of the embodiment. The Y-axis receiving coil 42 is not shown in the diagram.

The X-axis winding core parts 30*a*1, 30*a*2, 30*b*1, and 30*b*2 extend in the X-axis direction, around which X-axis receiving coils 32*a*1, 32*a*2, 32*b*1, and 32*b*2 are wound. When the magnetic flux Φ of the external magnetic field passes through the winding core parts in the +X direction as shown in the diagram, the induction magnetic field Φi is excited, and the spiral directions of the induction current I flowing in the X-axis winding core parts 30*a*1, 30*a*2, 30*b*1, and 30*b*2 become common as shown in the diagram.

The winding directions of the X-axis receiving coils 32*a*1, 32*a*2, 32*b*1, and 32*b*2 are common. Therefore, the flow directions in the winding direction of the induction currents I are common. Concretely, in the case of the embodiment, the induction current I flows in the +X direction in all of the X-axis receiving coils 32.

In the embodiment, the terminating end F3 of the X-axis receiving coil 32*b*1 and the starting end S4 of the X-axis receiving coil 32*b*2 are electrically connected to each other via the wire Wx. Similarly, the terminating end F4 of the X-axis receiving coil 32*b*2 and the starting end S1 of the X-axis receiving coil 32*a*1 are electrically connected to each other via the wire Wx. The terminating end F1 of the X-axis receiving coil 32*a*1 and the starting end S2 of the X-axis receiving coil 32*a*2 are also electrically connected to each other via the wire Wx.

As described above, by connecting the starting end and the terminating end of an X-axis receiving coil to each other, the induction currents I excited by the X-axis receiving coils are added to each other, and the resultant is output from the receiving antenna coil 10.

Figure 7:
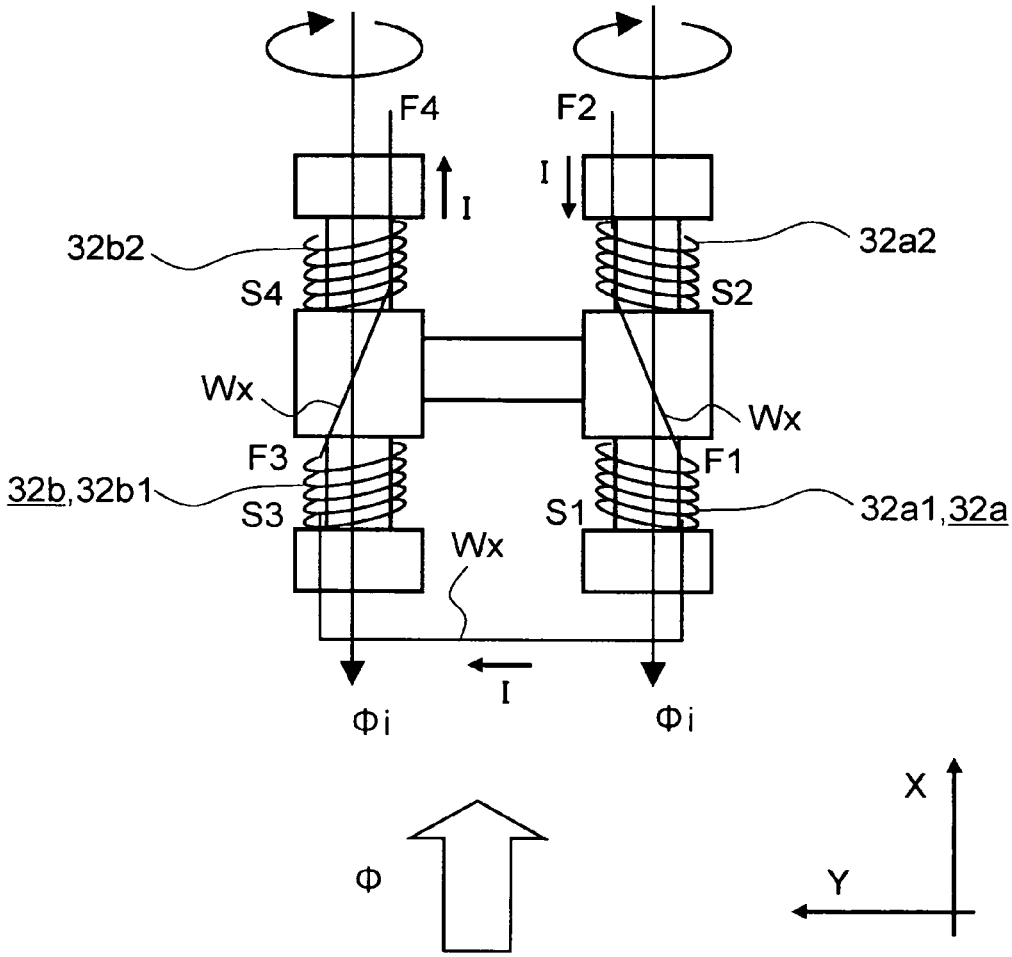
FIG. 7 is an XY plane schematic view showing a second example of the winding mode of the X-axis receiving coil of the embodiment.

FIG. 7 is an XY plane schematic view showing a second example of the winding mode of the X-axis receiving coil 32 wound around the core 20 of the embodiment.

The example is different from the first example with respect to the point that the winding directions of the two columns of X-axis receiving coils 32*a* and 32*b* which are parallel with each other are opposite to each other, and the starting ends or the terminating ends are connected to each other. Concretely, the winding direction of the X-axis receiving coil 32*b* (the X-axis receiving coils 32*b*1 and 32*b*2) is set as a clockwise direction, and the winding direction of the X-axis receiving coil 32*a* (the X-axis receiving coils 32*a*1 and 32*a*2) is set as a counterclockwise direction.

By electrically connecting the starting end S3 of the X-axis receiving coil 32*b*1 and the starting end S1 of the X-axis receiving coil 32*a*1 via the wire Wx, the induction currents I excited in the X-axis receiving coils 32*a* and 32*b* are added and the resultant is output.

The starting end and the terminating end of the X-axis receiving coils wound around the same bar of the winding core part in the common winding direction are connected to each other. Concretely, the terminating end F3 of the X-axis receiving coil 32*b*1 and the starting end S4 of the X-axis receiving coil 32*b*2 are electrically connected to each other via the wire Wx. The terminating end F1 of the X-axis receiving coil 32*a*1 and the starting end S2 of the X-axis receiving coil 32*a*2 are electrically connected to each other via the wire Wx.

Figure 8:
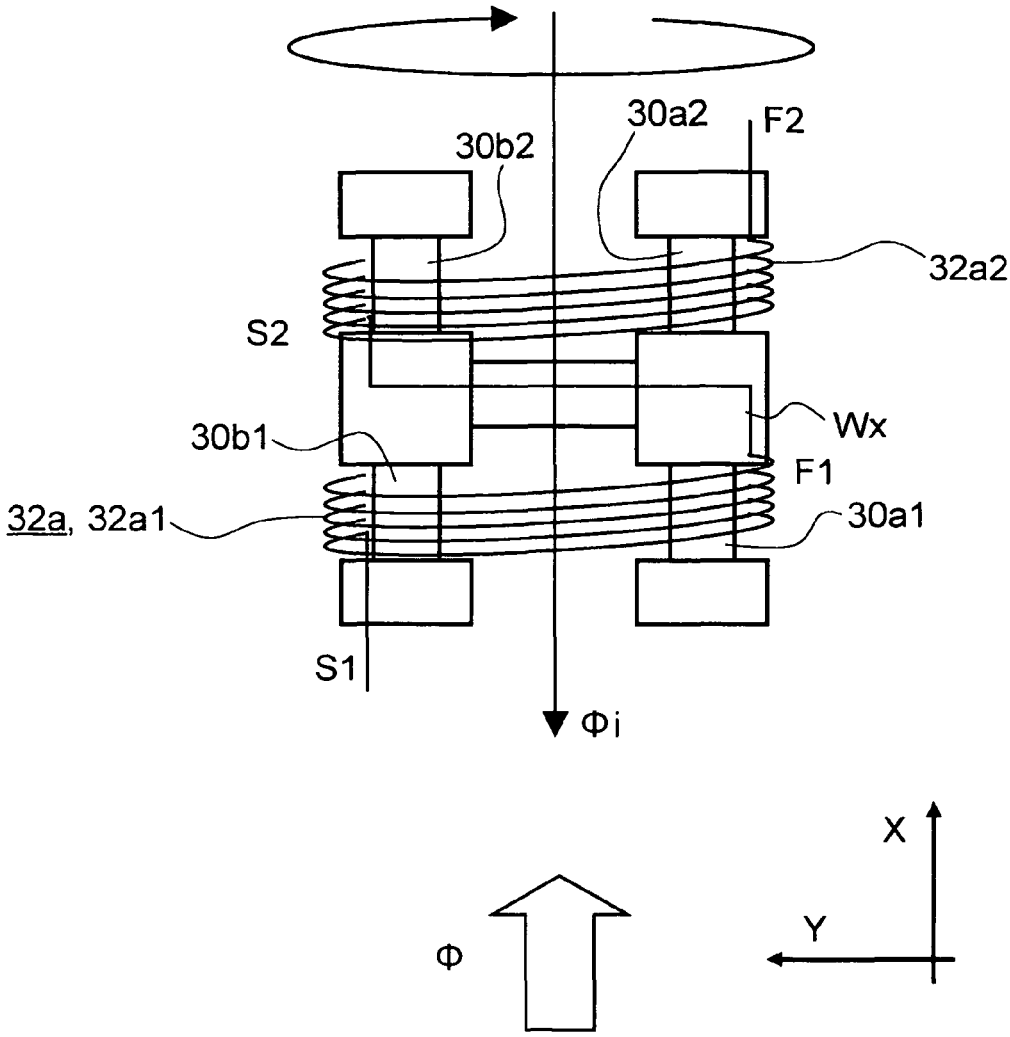
FIG. 8 is an XY plane schematic view showing a third example of the winding mode of the X-axis receiving coil of the embodiment.

FIG. 8 is an XY plane schematic view showing a third example of the winding mode of the X-axis receiving coil 32 wound abound the core 20 of the embodiment.

The X-axis receiving coils 32*a*1 and 32*a*2 of the example are wound around the two bars of X-axis winding core parts 30*a* and 30*b* which are parallel with each other. Concretely, the X-axis receiving coil 32*a*1 is wound around the X-axis winding core parts 30*a*1 and 30*b*1, and the X-axis receiving coil 32*a*2 is wound around the X-axis winding core parts 30*a*2 and 30*b*2.

The winding directions of the X-axis winding core parts 30*a*1 and 30*a*2 are common.

The terminating end F1 of the X-axis receiving coil 32*a*1 and the starting end S2 of the X-axis receiving coil 32*a*2 are electrically connected to each other via the wire Wx. Therefore, in the case where the magnetic flux Φ of the external magnetic field is applied in the +X direction as shown in the diagram, the induction currents I induced in the X-axis winding core parts 30*a*1 and 30*a*2 are added to each other.

As described above, the receiving antenna coil 10 of the embodiment is not limited to the case where the X-axis receiving coil 32 is wound around each of the plurality of bars of X-axis winding core parts 30. The X-axis receiving coil 32 may be wound around the plurality of bars of X-axis winding core parts 30 in a bundle.

The core 20 of the embodiment has an H-letter shape in the XY plane and does not have a loop. With the configuration, as compared with the receiving antenna coil 10 of the first embodiment, winding of the X-axis receiving coil 32 and the Y-axis receiving coil 42 around the winding core parts of the core 20 is easier.

Specifically, in the case where the core 20 is constructed as an integral loop core as in the first embodiment, to wind a coil around a winding core part, a winding apparatus dedicated to a toroidal core, whose head reciprocates like a sewing machine is required. In contrast, in the case of the core 20 having no loop in the winding core part as in the embodiment, by sliding the chucked core 20 in the axial direction while rotating the core 20 in the X axis or the Y axis, the coil can be easily wound around a winding core.

Third Embodiment

Figure 9:
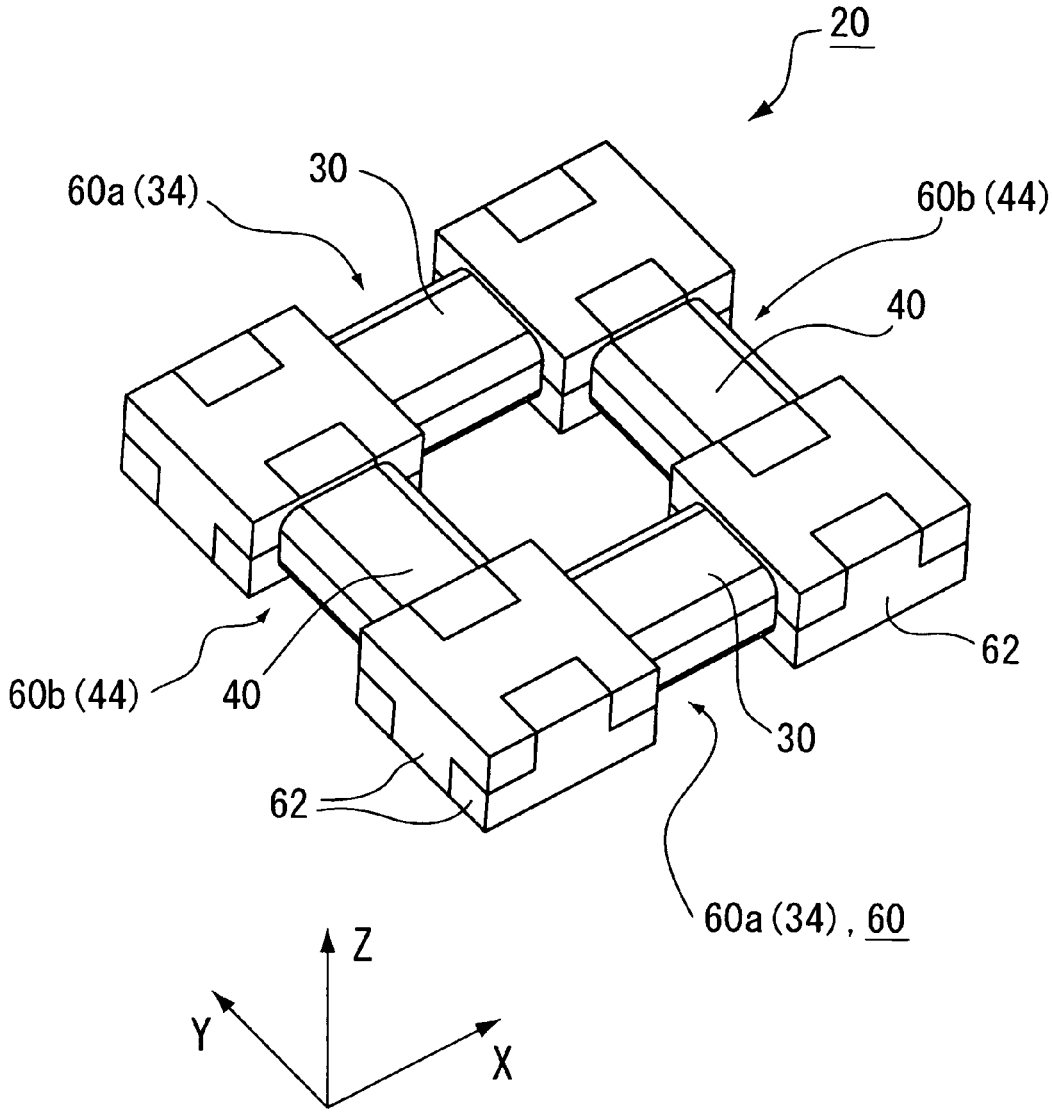
FIG. 9 is a perspective view showing an example of a core as a third embodiment.

FIG. 9 is a perspective view showing an example of the core of the embodiment.

The core 20 of the embodiment is constructed by combining an X-axis core 34 including the X-axis winding core part 30 and a Y-axis core 44 including the Y-axis winding core part 40. The embodiment is different from the first embodiment with respect to the point that at least one of the X-axis core 34 and the Y-axis core 44 has an engagement part 62 for making the X-axis core 34 and the Y-axis core 44 engage with each other.

The X-axis core 34 may be made of a single member having a plurality of bars of X-axis winding core parts 30 or may be constructed by combining a plurality of members each having a single bar of X-axis winding core part 30. The Y-axis core 44 has a similar configuration.

The core 20 of the embodiment is constructed by combining the plurality of X-axis cores 34 or Y-axis cores 44. The X-axis core 34 has a single bar of X-axis winding core part 30, and the Y-axis core 44 has a single bar of Y-axis winding core part 40.

In the embodiment, the expression that "the X-axis core 34 has a single bar of X-axis winding core part 30" means that only one X-axis winding core part 30 projects in the +X direction or the −X direction from the engagement part 62. That is, the expression that "the X-axis core 34 has a single bar of X-axis winding core part 30" excludes a state where two or more X-axis winding core parts 30 extend in the +X direction or the −X direction from the engagement part 62 of the X-axis core 34, and a state where the X-axis core 34 does not have any X-axis winding core part 30.

In the case where one X-axis winding core part 30 extends in each of the ±X directions from the engagement part 62, regardless of whether two X-axis winding core parts 30 are arranged in a single straight line or not, the two X-axis winding core parts 30 are regarded as a single bar of X-axis winding core part 30.

The Y-axis core 44 is similarly constructed.

More concretely, the core 20 of the embodiment is constructed in a rectangular loop shape in XY plane view by combining total four division cores 60, two division cores 60 (division cores 60*a* and 60*b*) having the same dimension each in the X-axis and Y-axis directions. Specifically, each of the two parallel division cores 60*a* extending in the X-axis direction is provided as the X-axis core 34, and each of the two parallel division cores 60*b* extending in the Y-axis direction is provided as the Y-axis core 44.

Figure 10:
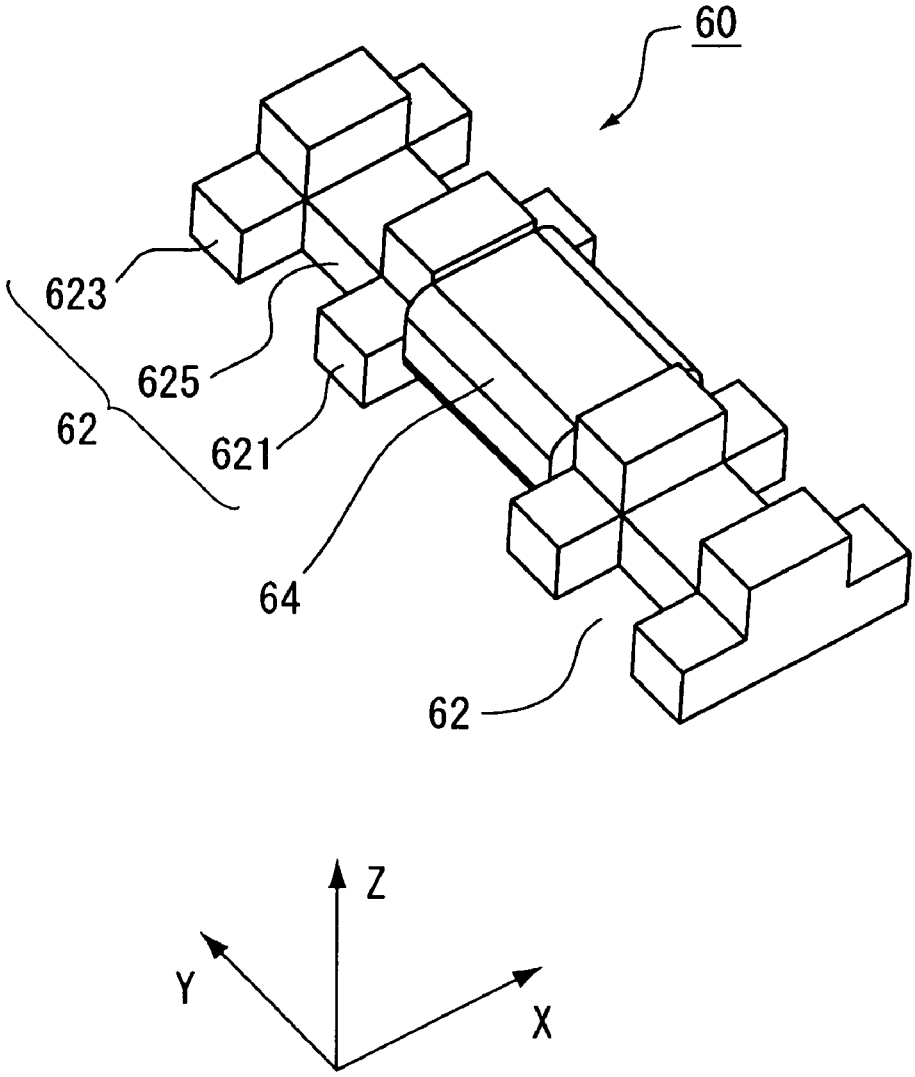
FIG. 10 is a perspective view of a division core.

FIG. 10 is a perspective view of the division core 60.

The division core 60 may be manufactured integrally by a magnetic material such as ferrite. Alternatively, the engagement part 62 and the winding core part 64 may be made of different materials.

In the case of the embodiment, the engagement part 62 is made of a resin material as a nonmagnetic material and can be obtained by, for example, injection molding.

The X-axis winding core part 30 and the Y-axis winding core part 40 are made of a magnetic material such as a ferrite material, and each of them can be obtained by being sintered in a rod shape and performing cutting work as necessary.

The division core 60 (the X-axis core 34 and the Y-axis core 44) is constructed by combining the engagement part 62 and the winding core part 64 (the X-axis winding core part 30 and the Y-axis winding core part 40) attached to the engagement part 62.

The peripheral length of the engagement part 62 is longer than that of each of the X-axis winding core part 30 and the Y-axis winding core part 40. The engagement part 62 is a flange which prevents loosening of the X-axis receiving coil 32 or the Y-axis receiving coil 42.

More concretely, the engagement parts 62 of the embodiment are provided at both ends of a winding core part 64. The engagement part 62 has a flange 621 whose peripheral length is longer than that of the winding core part 64, and tip blocks 623 positioned at both ends of the division core 60. The engagement part 62 is a coupling member for integrally combining the four division cores 60 by being engaged with the engagement part 62 of another division core 60 neighboring in a 90-degree rotated state.

The engagement part 62 has a groove 625 in which the engagement part 62 of the neighboring division core 60 is fit, between the flange 621 and the tip block 623. The flange 621 has the function of preventing loosening of the wire wound around the winding core part 64.

In the receiving antenna coil 10 of the embodiment, each of the X-axis core 34 and the Y-axis core 44 has the engagement part 62. The engagement part 62 of the X-axis core 34 and the engagement part 62 of the Y-axis core 44 have the same shape.

More concretely, in the embodiment, the engagement part 62 is standardized for four pieces in total including the X-axis cores 34 and the Y-axis cores 44. A pair of engagement parts 62 attached at both ends of the winding core part 64 have the same shape.

Further, also for the winding core part 64, the X-axis core 34 and the Y-axis core 44 are standardized.

With the configuration, the receiving antenna coil 10 of the embodiment is constructed by the small number of parts, concretely, only by two kinds of members.

Figure 11:
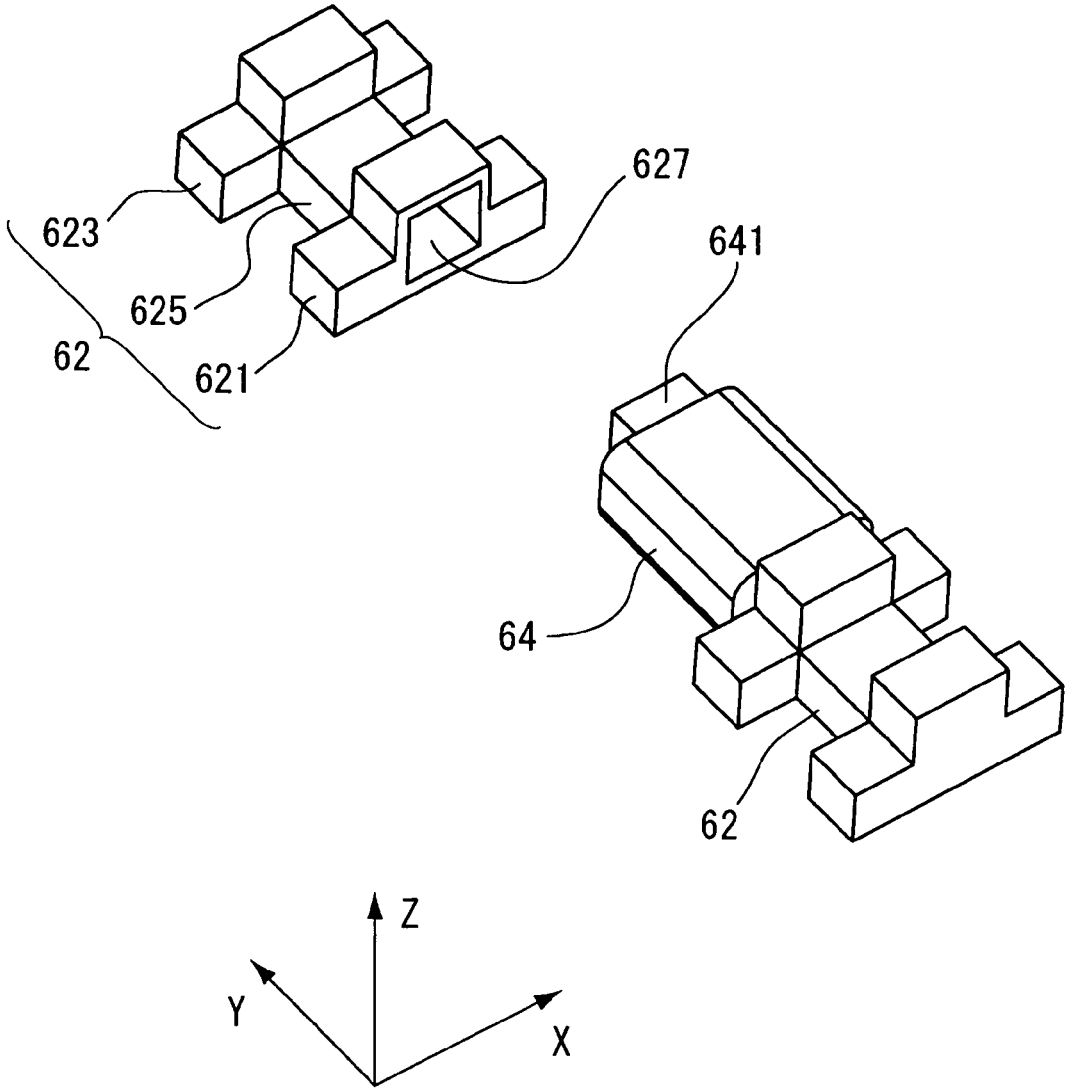
FIG. 11 is a perspective view showing a state where an engagement part and a winding core part are separated.

FIG. 11 is a perspective view showing a state where the engagement part 62 and the winding core part 64 are separated. The rod-shaped winding core part 64 has an insertion part 641 having a small diameter at an end in the winding direction. The insertion parts 641 are provided at both ends of the winding core part 64.

In the flange 621 of the engagement part 62, a recessed groove 627 to which the insertion part 641 is inserted is provided. The recessed groove 627 is formed so as to come into engagement with the insertion part 641. With the configuration, the engagement parts 62 can be attached from both end sides to the insertion parts 641 at both ends of the winding core part 64.

The core 20 of the embodiment is constructed by combining the X-axis core 34 and the Y-axis core 44 each having the winding core part. At least one of the X-axis core 34 and the Y-axis core 44 (in the embodiment, both of them) has the engagement part 62 for making the X-axis core 34 and the Y-axis core 44 engage with each other. With the configuration, the core 20 having the rectangular loop shape in the XY plane view can be obtained by combining the I-shaped division cores 60 (the X-axis core 34 and the Y-axis core 44) around which wires can be easily wound. Therefore, by preliminarily manufacturing the X-axis core 34 in which the X-axis receiving coil 32 is wound around the X-axis winding core part 30 and the Y-axis core 44 in which the Y-axis receiving coil 42 is wound around the Y-axis winding core part 40 separately and combining them, the receiving antenna coil 10 of the embodiment can be easily obtained.

Different from a transmission antenna, the antenna characteristic of the receiving antenna of the embodiment does not deteriorate by making the core 20 have the divided configuration of the X-axis core 34 and the Y-axis core 44 for the following reason. As described above, the magnetic flux Φ of the external magnetic field detected by the receiving antenna coil 10 passes through the core 20 excellently, the reception sensitivity of the X-axis receiving coil 32 and the Y-axis receiving coil 42 does not deteriorate due to the existence of the combination interface of the X-axis core 34 and the Y-axis core 44.

The X-axis core 34 and the Y-axis core 44 of the embodiment are attached to the engagement part 62 made of a resin material via the X-axis winding core part 30 and the Y-axis winding core part 40 made of a ferrite material, respectively. Thus, both excellent reception characteristic obtained by the high magnetic permeability of the ferrite material and the excellent engagement of the division cores with low brittleness of the resin material are realized. By excellent workability of the resin material, a complicated engagement shape of the engagement part 62 can be easily realized by, for example, injection molding.

Since the magnetic flux Φ of the external magnetic field passes through the core 20 regardless of whether the core 20 is made of the magnetic material or the nonmagnetic material, even when the engagement part 62 is made of a resin material as a nonmagnetic material, the reception characteristic of the receiving antenna coil 10 does not deteriorate.

The core 20 of the embodiment is constructed by combining the plurality of X-axis cores 34 or Y-axis cores 44, the X-axis core 34 has a single bar or X-axis core winding part 30, and the Y-axis core 44 has a single bar of Y-axis core winding part 40. That is, the X-axis core 34 and the Y-axis core 44 have a division configuration made of the parts. With the configuration, by preliminarily winding a wire on each bar of the X-axis core 34 and the Y-axis core 44 and engaging the X-axis core 34 and the Y-axis core 44 via the engagement part 62, the core 20 can be obtained. Consequently, the coil can be easily wound around the core 20 having a plurality of winding core parts.

It is apparent that the present invention is not limited to the above embodiments, and may be modified and changed without departing from the scope and spirit of the invention.

What is claimed is:

1. A receiving antenna coil, comprising:

a core including an X-axis winding core part extending in an X-axis direction and a Y-axis winding core part extending in a Y-axis direction crossing said X-axis direction;

an X-axis receiving coil wound around said X-axis winding core part and a Y-axis receiving coil wound around said Y-axis winding core part; and a Z-axis receiving coil wound in a Z-axis direction crossing both said X-axis direction and said Y-axis direction so as to surround said X-axis winding core part and said Y-axis winding core part, wherein said X-axis winding core part and said Y-axis winding core part each comprises a magnetic material and are provided in a same plane, and said X-axis winding core part comprises one or more bars provided in a plurality of places in said Y-axis direction, and said Y-axis winding core part comprises one or more bars provided in a plurality of places in said X-axis direction, and wherein said X-axis winding core part and said Y-axis winding core part form a closed rectangular loop shape or an H-letter shape in an XY plane.

2. The receiving antenna coil according to claim 1, wherein said X-axis receiving coil or said Y-axis receiving coil is wound around said X-axis winding core part or said Y-axis winding core part made in said plurality of bars, and wherein said X-axis receiving coils or said Y-axis receiving coils wound around said plurality of bars are connected to each other in a direction of adding currents excited by an external magnetic field.

3. The receiving antenna coil according to claim 1, wherein said core is constructed by combining an X-axis core including said X-axis winding core part and a Y-axis core including said Y-axis winding core part, and wherein at least one of said X-axis core and said Y-axis core comprises an engagement part for making said X-axis core and said Y-axis core fit each other.

4. The receiving antenna coil according to claim 3, wherein said core is constructed by combining a plurality of said X-axis cores or said Y-axis cores, and wherein said X-axis core comprises one bar of said X-axis winding core part, or said Y-axis core comprises one bar of said Y-axis winding core part.

5. The receiving antenna coil according to claim 3, wherein a peripheral length of said engagement part is longer than peripheral lengths of each of said X-axis winding core part and said y-axis winding core part, and wherein said engagement part comprises a flange that prevents loosening of said X-axis receiving coil or said Y-axis receiving coil.

6. The receiving antenna coil according to claim 3, wherein said engagement part comprises a resin material, said X-axis winding core part and said Y-axis winding core part comprising a ferrite material, and wherein said X-axis core or said Y-axis core comprising said engagement part is constructed by combining the engagement part and said X-axis winding core part or said Y-axis winding core part attached to the engagement part.

7. The receiving antenna coil according to claim 6, wherein each of said X-axis core and said Y-axis core comprises said engagement part, and wherein said engagement part of said X-axis core and said engagement part of said Y-axis core comprise a same shape.

8. The receiving antenna coil according to claim 1, further comprising a Z-axis core comprising a nonmagnetic material, around which said Z-axis receiving coil is to be wound.

9. The receiving antenna coil according to claim 8, wherein said Z-axis core comprises a tube shape, and said core is housed in said Z-axis core.

10. The receiving antenna coil according to claim 1, wherein said one or more bars of said X-axis winding core part extending in said X-axis direction are formed in parallel.

11. The receiving antenna coil according to claim 10, wherein intermediate parts in the longitudinal direction of said one or more bars of said X-axis winding core part are connected to each other via said Y-axis winding core part extending in said Y-axis direction.

12. A receiving antenna coil, comprising:

a core including an X-axis winding core part comprising a magnetic material extending in an X-axis direction and a Y-axis winding core part comprising a magnetic material extending in a Y-axis direction crossing said X-axis direction;

an X-axis receiving coil wound around said X-axis winding core part and a Y-axis receiving coil wound around said Y-axis winding core part; and a Z-axis receiving coil wound in a Z-axis direction crossing both said X-axis direction and said Y-axis direction so as to surround said X-axis winding core part and said Y-axis winding core part, wherein said X-axis winding core part and said Y-axis winding core part are respectively formed in a plurality of bars, wherein said core is constructed by combining an X-axis core including said X-axis winding core part and a Y-axis core including said Y-axis winding core part, and wherein said X-axis core and said Y-axis core are provided in a same plane and form an open rectangular loop shape, and wherein at least one of said X-axis core and said Y-axis core comprises an engagement part for making said X-axis core and said Y-axis core fit each other.

13. A receiving antenna coil, comprising:

a core being configured in a square shape, said square shape being orientated in a plane along an X-axis direction and a Y-axis direction, said core comprising:

a first flange provided in a first corner of the square shape;

a second flange provided in a second corner of the square shape;

a third flange provided in a third corner of the square shape;

a fourth flange provided in a fourth corner of the square shape;

a first rod provided between the first flange and the second flange;

a second rod provided between the second flange and the third flange;

a third rod provided between the third flange and the fourth flange;

a fourth rod provided between the first flange and the fourth flange;

a first X-axis receiving coil wound around the first rod;

a second X-axis receiving coil wound around the third rod, said first X-axis receiving coil and said second X-axis receiving coil being electrically connected;

a first Y-axis receiving coil wound around the second rod;

a second Y-axis receiving coil wound around the fourth rod, the first Y-axis receiving coil and the second Y-axis receiving coil being electrically connected; and a Z-axis receiving coil wound in a Z-axis direction crossing both the X-axis direction and the Y-axis direction so as to surround said X first rod, second rod, third rod, and fourth rod, wherein each of said first rod, said second rod, said third rod, and said fourth rod comprise a magnetic material and is provided in the plane along the X-axis direction and the Y-axis direction.

14. The receiving antenna coil according to claim 13, wherein each of said first rod, said second rod, said third rod, and said fourth rod comprises a corner-rounded rectangular shape in a direction perpendicular to a winding direction of a respective one of the first X-axis receiving coil, the second X-axis receiving coil, the first Y-axis receiving coil, and the second Y-axis receiving coil.

15. The receiving antenna coil according to claim 14, wherein the corner-rounded rectangular shape includes a long side in a plane along the X-axis direction and the Y-axis direction, and a short side along a Z-axis plane.

16. The receiving antenna coil according to claim 13, wherein the Z-axis receiving coil comprises a rectangular tube shape.

17. The receiving antenna coil according to claim 13, wherein a winding length of the Z-axis receiving coil is equal to a thickness dimension of the core.

18. The receiving antenna coil according to claim 13, wherein the Z-axis receiving coil comprises a non-magnetic material.

19. The receiving antenna coil according to claim 13, wherein the core is housed within the Z-axis receiving coil.

* * * * *